United States Patent [19]

Houston

[11] Patent Number: 4,632,582

[45] Date of Patent: Dec. 30, 1986

[54] RIBBON FEED MECHANISM PROVIDING A CONSTANT RELATIVE VELOCITY BETWEEN RIBBON AND PRINT HEAD

[75] Inventor: Eric A. Houston, Cambridge, Mass.

[73] Assignee: Centronics Data Computer Corp., Hudson, N.H.

[21] Appl. No.: 704,257

[22] Filed: Feb. 22, 1985

[51] Int. Cl.[4] ..... B41J 33/08; B41J 33/38

[52] U.S. Cl. ..... 400/232; 400/229

[58] Field of Search ..... 101/228; 400/248, 208, 400/229, 232

[56] References Cited

U.S. PATENT DOCUMENTS

| | | | |
|---|---|---|---|
| 2,609,077 | 9/1952 | Schroder | 400/235 |
| 2,734,614 | 2/1956 | Page | 400/232 |
| 3,426,680 | 2/1969 | Kaufmann | 101/228 |
| 3,548,994 | 12/1970 | Hudson | 400/227 |
| 3,606,836 | 9/1971 | Colwill | 101/228 |
| 4,047,607 | 9/1977 | Willcox | 400/208 |
| 4,047,608 | 9/1977 | Willcox | 400/208 |
| 4,066,016 | 1/1978 | Tison | 101/228 |
| 4,260,271 | 4/1981 | Kondur, Jr. | 400/229 |
| 4,297,043 | 10/1981 | Dargatz | 400/232 |
| 4,372,697 | 2/1983 | Babcock | 400/232 |
| 4,405,247 | 9/1983 | Hanna | 400/196.1 |
| 4,486,107 | 12/1984 | Willcox | 400/248 |

FOREIGN PATENT DOCUMENTS

| | | | |
|---|---|---|---|
| 102474 | 3/1984 | European Pat. Off. | 400/232 |
| 103881 | 6/1982 | Japan | 400/232 |

OTHER PUBLICATIONS

Halter et al, "Off Carrier Ribbon Supply", IBM Technical Disclosure Bulletin, vol. 22, No. 5, p. 1745, 10/79.

*Primary Examiner*—William Pieprz

*Attorney, Agent, or Firm*—Pahl, Lorusso & Loud

[57] ABSTRACT

A ribbon feed mechanism for a bi-directional printer that produces a constant relative ribbon to print-head velocity. The invention produces the constant relative velocity by coupling the ribbon to the print-head through a reciprocating shuttle, which moves in an opposite direction to and at one-half the speed of the print-head. As the shuttle reciprocates it engages the ribbon such that a constant length is maintained between the ribbon supply and the print-head and between the print-head and the ribbon take-up. The ribbon is taken up at a constant speed. By this method, the relative ribbon to print-head speed is fixed at the ribbon take-up speed.

3 Claims, 1 Drawing Figure

RIBBON FEED MECHANISM PROVIDING A CONSTANT RELATIVE VELOCITY BETWEEN RIBBON AND PRINT HEAD

BACKGROUND OF THE INVENTION

This invention relates generally to a ribbon feed mechanism for a bi-directional printer, and more specifically to a ribbon feed mechanism that provides a constant relative velocity between the ribbon and a horizontally traversable print head. Modern printers commonly print in both left-to-right and right-to-left directions. Depending on the type of the printer ribbon, it is desirable and often necessary to maintain fresh ribbon at the printing point. Present methods accomplish this result by maintaining the ribbon at a constant velocity relative to the stationary paper, regardless of the velocity (or direction) of the print head. This operation produces two undesirable results. First, variations in relative ribbon to print head velocity cause color density variations which detract from the printed document's appearance. Second, a relatively large volume of ribbon has to be passed through the system.

Among the several objects of this invention is to provide a ribbon feed system for a printer which prints at high speeds in both directions and produces a uniform and acceptable color density in all phases of printing; to provide such a system that utilizes a very high percentage of the length of a ribbon; to provide such a system which is of relatively simple and inexpensive construction, and which may be easily incorporated into the design of printers of standard design.

SUMMARY OF THE INVENTION

The invention achieves the several objectives by coupling the ribbon speed to the print head speed through a shuttle, such that the relative speed of the ribbon relative to the print head is constant. Briefly, in a ribbon feed mechanism for a printer constructed according to this invention, paper to be printed upon is maintained upon a stationary platen. A printhead traverses the length of the platen, printing characters in both the left-to-right and right-to-left directions. An inked ribbon supported on the machine frame is arranged to follow a path defined in part by a movable shuttle. Means are provided connecting the print head to the shuttle, such that the shuttle moves in a direction opposite to and at one-half the speed of the print head. The shuttle is designed and arranged such that a loop of ribbon is formed on each side of the shuttle. As the shuttle moves, ribbon is played out by one loop and taken up by the other at the same rate. The ribbon path length between the ribbon supply point and the print head always remains constant, as does the ribbon path length between the print-head and the ribbon take-up means. Means are provided for taking up the spent ribbon at a constant speed at all times during operation of the print head. Consequently, the relative velocity between the ribbon and the print head also remains constant, and exactly equal to the speed the ribbon is taken up.

DETAILED DESCRIPTION OF THE PREFERRED EMBODIMENT

Figure 1:
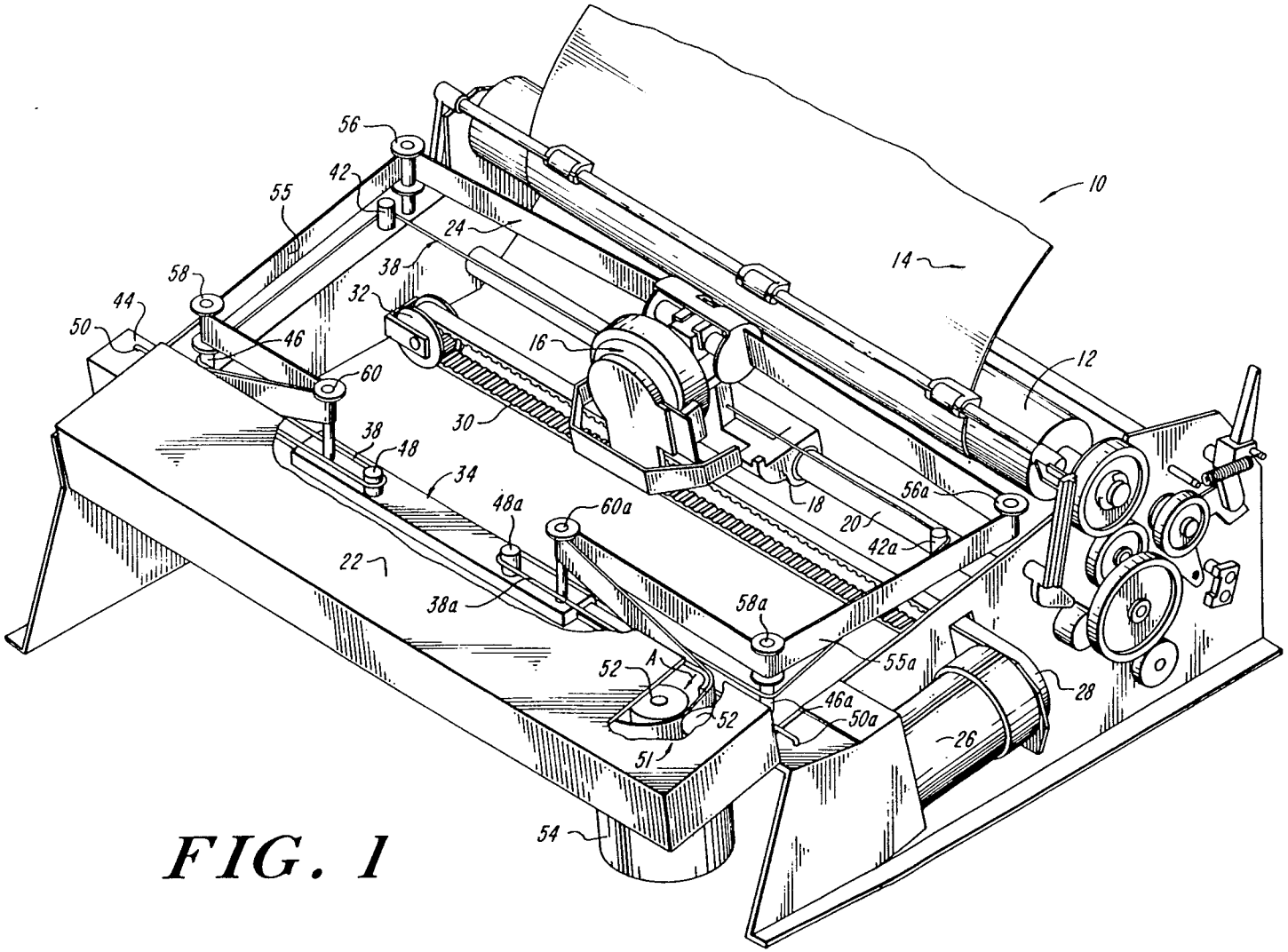
FIG. 1 shows an isometric view of the preferred embodiment of the invention.

Referring to FIG. 1, a printer 10 has a rotating platen 12 around which a piece of paper 14 may be trained. A conventional print head 16, e.g., of the dot-matrix type is mounted on a carriage assembly 18 riding on carriage guide 20 so as to be translatable along the platen 12. A ribbon cartridge 22 provides an endless ribbon, a portion of which 24 extends along the platen 12. Thus, by appropriately energizing the print head 16, printed characters may be formed on the paper 14.

Traversing of the carriage assembly 18 is performed by means of a servo-motor 26 which is coupled to the carriage by means of intermediate gearing 28 and an endless cogged belt 30 which passes around pulleys 32 adjacent each of the ends of the guide 20. Co-ordination of the operations of the servo-motor 26 and the print head 16 is preferably controlled by a dedicated micro-processor/firmware system as is conventional in the present state of the art.

A shuttle 34 is mounted on a slide, not shown, permitting lateral movement of the shuttle. An inelastic band, 38 such as mylar film, steel wire, or dacron line, is attached to the left side of the carriage assembly 18. The inelastic band passes parallel to the carriage guide 20, around pulleys 42 and 46 mounted on the frame 44 of the printer. Pulley 46 is substantially in line with the shuttle movement. The inelastic band continues around said pulley 46 along a path substantially parallel to the shuttle movement, where it engages a pulley 48 which is attached to the shuttle 34. There the band reverses direction, travels along a path again substantially parallel to the shuttle movement, and terminates at an end that is fixed to the frame, essentially at location 50.

An identical inelastic band 38*a*, is attached to the right side of the carriage assembly 18, passes parallel to the print guide 20, around pulleys 42*a* and 46*a*, along a path substantially parallel to the shuttle movement and substantially co-linear with the corresponding portion of the path of inelastic band 38. Band 38*a* passes around pulley 48*a* mounted on the shuttle 34, reverses direction, travels along a path substantially parallel to the path of the band between pulleys 46*a* and 48*a*, and then terminates at an end that is fixed to the frame at essentially location 50*a*.

The ribbon cartridge is equipped with means 51, such as a pair of closely spaced opposing rollers 52, to take up the ribbon into one end of the cartridge in a direction indicated by the arrow A at a constant speed. The take up means may be driven by a conventional motor 54, that is controlled by the dedicated micro-processor/-firmware system mentioned previously. If desired, the take up means may be energized so as to take up the ribbon only during actual printing operation of the print head.

The ribbon follows a path essentially paralleling the various segments of the two inelastic bands 38 and 38*a* outlined above. A portion of the ribbon 24 extends along the platen 12. Slightly beyond each end of the platen 12, portions of the ribbon 55 and 55*a*, pass around pulleys 56 and 56*a*, respectively, which are mounted to the printer frame. Portions 55 and 55*a* of the ribbon continue around pulleys 58 and 58*a*, attached to the frame on common axles with and above pulleys 46 and 46*a*, respectively, near opposite ends of the shuttle path. The two portions of the ribbon travel toward each other, and then reverse direction around pulleys 60 and 60*a* mounted on the shuttle. The portion of the ribbon 55*a* then travels along a path substantially parallel to the path the ribbon travelled between pulleys 58*a* and 60*a*, and passes through the take-up means 51. The portion of the ribbon 55 emerges from an opening in the cartridge, where it is engaged by friction means for maintaining a constant tension.

The principal aspect of this invention is that it couples the speed and direction of the ribbon 24 adjacent the print head 16 to the print head speed and direction of motion, through the shuttle 34. The invention accomplishes this effect by maintaining the ribbon path length between the ribbon supply point and the print head constant and by maintaining the ribbon path length between the print head and the ribbon take-up point constant and equal to the ribbon supply to printhead path length, maintaining both ribbon path lengths constant regardless of printhead motion. According to the arrangement shown in FIG. 1, the shuttle 34 will travel in a direction opposite to that of the print head at any given instant. The shuttle also moves at one-half the speed of the print-head, and travels one half the distance. Consequently, the points of attachment 50 and 50*a* must be spaced far enough apart so that the shuttle, which is constrained to travel between them, will be able to travel at least one-half the travel path of the print head.

The lineal speed of the ribbon with respect to a stationary reference at the take-up means 52 will always be a constant speed Vc, as dictated by the take-up means 52. As the print head 16 moves from left to right at a speed Vph, the shuttle will move from right to left at a speed (−)Vph/2. As a consequence of the routing of the ribbon through the shuttle, the portion of the ribbon adjacent the platen will move at a speed of Vph+Vc. Thus, the relative ribbon to print head speed is Vc. Similarly, when the print head moves in an opposite direction, at a speed −Vph, the ribbon will move at a speed −Vph+Vc. Consequently, the relative ribbon to print head speed is again Vc.

Another embodiment, not shown in the figures, accomplishes the coupling between the print head 16 and the shuttle 34, by directly connecting the shuttle to the servo motor 26 through a gear system and an endless cogged belt, rather than by means of the inelastic bands 38 and 38*a*. In this second embodiment, an endless cogged belt engages the shuttle in the same manner as the endless cogged belt 30 engages the print head. The endless cogged belt is connected to the drive shaft of the servo motor through a gear system that drives the cogged belt at one half the speed of the print head, and in the opposite direction. Alternatively, the direction reversing and speed reducing gear system may be placed between the cogged belt and the shuttle itself.

In still another embodiment of the invention, the shuttle, the rollers 58 and 58*a* and 46 and 46*a*, and the shuttle guide are all contained within a removable ribbon cartridge.

Thus, the invention accomplishes the objects of providing a constant relative velocity between the ribbon and the print head, and utilizing a very high percentage of the length of a ribbon. The invention accomplishes these objectives by providing a system that may be constructed relatively inexpensively and that may be easily incorporated into printers of standard design.

As variations could be made in the above constructions without departing from the scope of the invention, it should be understood that all matter contained in the above description or shown in the accompanying drawings shall be interpreted as illustrative and not limiting.

Having described my invention, I claim:

1. A ribbon feed mechanism for a printer designed to print on paper having a frame, and a platen comprising:
   - traversable print head means adjacent the platen, for printing on paper overlaying the platen;
   - driving means for selectively driving said print head means along a print line according to designated locations;
   - a ribbon that is supported on the printer frame;
   - ribbon supply means for storing said ribbon;
   - ribbon take-up means, which take-up means is able to take up said ribbon at a constant lineal speed;
   - ribbon guide means for guiding said ribbon from said ribbon supply means, to a position adjacent the platen and between said print head means and the platen, and then to said ribbon take-up means; and
   - mechanical coupling means for maintaining a constant relative velocity between the portion of said ribbon adjacent to said platen and said print head means comprising:
   - a shuttle;
   - a mechanical linkage means that drives the shuttle in a direction opposite to that of the print head means and at one-half the speed of the print head means comprising;
   - a pair of inelastic bands attached to said print head means, which bands extend away from the print head along opposite, substantially co-linear paths substantially parallel to said print line, around a first and second pair of freely rotatable pulleys fixed to the frame, around a pair of freely rotatable pulleys attached to said shuttle, and terminating at points stationary relative to the frame, spaced apart a distance sufficient to allow the shuttle to travel at least one-half the maximum travel range of said print head means; and
   - means for creating a ribbon path which trains the ribbon through the shuttle after the ribbon has been guided from the ribbon supply means and before said ribbon is supported adjacent to said platen, and then trains the ribbon adjacent said platen and then through the shuttle again before the ribbon is taken up by said take-up means, such that the ribbon forms a pair of loops on either side of the shuttle, such that as the shuttle moves, the length of ribbon in the loop toward which the shuttle moves decreases and the length of ribbon in the opposite loop increases by an amount equal to the amount of the decrease of the first loop.

2. The ribbon feed mechanism of claim 1, wherein said ribbon, ribbon supply means and ribbon take-up means are contained in a removable ribbon supply system means.

3. The ribbon feed mechanism of claim 2 wherein said shuttle is contained in the removable ribbon supply system means.

* * * * *